US008662355B2

(12) United States Patent
Spiegelberg et al.

(10) Patent No.: US 8,662,355 B2
(45) Date of Patent: Mar. 4, 2014

(54) SPLIT BODY PUMPS FOR FOAM DISPENSERS AND REFILL UNITS

(75) Inventors: Todd A. Spiegelberg, North Ridgeville, OH (US); John J. McNulty, Broadview Heights, OH (US); Robert L. Quinlan, Stow, OH (US); Nick E. Ciavarella, Seven Hills, OH (US); Stephen P. Casteel, Canal Fulton, OH (US)

(73) Assignee: GOJO Industries, Inc., Akron, OH (US)

( * ) Notice: Subject to any disclaimer, the term of this patent is extended or adjusted under 35 U.S.C. 154(b) by 103 days.

(21) Appl. No.: 13/208,076

(22) Filed: Aug. 11, 2011

(65) Prior Publication Data

US 2013/0037573 A1 Feb. 14, 2013

(51) Int. Cl.

| | |
|---|---|
| ***B67D 7/76*** | (2010.01) |
| ***G01F 11/00*** | (2006.01) |
| ***B67D 7/78*** | (2010.01) |
| ***B67D 7/06*** | (2010.01) |

(52) U.S. Cl.
USPC ..... 222/190; 222/325; 222/145.5; 222/181.1

(58) Field of Classification Search
USPC ..... 222/190, 325, 135, 145.5, 181.3, 181.1
See application file for complete search history.

(56) References Cited

U.S. PATENT DOCUMENTS

| | | | | |
|---|---|---|---|---|
| 4,477,000 | A | 10/1984 | Arabian | |
| 5,339,988 | A | 8/1994 | Palmer et al. | |
| 5,398,845 | A * | 3/1995 | Meyer | 222/1 |
| 5,445,288 | A | 8/1995 | Banks | |
| 5,544,788 | A | 8/1996 | Meyer | |
| 5,779,104 | A | 7/1998 | Reidel | |
| 5,862,954 | A | 1/1999 | Ehrensperger et al. | |
| 6,082,586 | A * | 7/2000 | Banks | 222/95 |
| 6,626,332 | B2 | 9/2003 | Ehrensperger et al. | |
| 6,644,516 | B1 * | 11/2003 | Foster et al. | 222/190 |
| 7,066,355 | B2 | 6/2006 | Lewis et al. | |

(Continued)

FOREIGN PATENT DOCUMENTS

| | | |
|---|---|---|
| WO | 99/49769 | 10/1999 |

*Primary Examiner* — Paul R Durand
*Assistant Examiner* — Benjamin R Shaw
(74) *Attorney, Agent, or Firm* — Calfee, Halter & Griswold LLP

(57) ABSTRACT

Foam dispensers, refill units for foam dispensers and liquid pumps for use in foam dispensers are disclosed herein. A refill unit for refilling a foam dispenser system is also disclosed herein. The foam dispenser has an air compressor secured thereto and the air compressor is not disposed of with the refill unit. The refill unit includes a liquid pump and a container for holding a foamable liquid that is connected to the liquid pump. The liquid pump includes a pump housing and a mixing chamber having an inlet check valve and an outlet check valve. The mixing chamber has an extended position with a first volume and a contracted position with a second volume. The pump housing includes an aperture therethrough configured to receive air from an air compressor that does not form part of the refill unit. One or more one-way sealing members are located within the pump housing between the aperture and the mixing chamber for preventing liquid from passing through the aperture in the pump housing for receiving air. A foaming element and outlet nozzle are located downstream of the mixing chamber. The refill unit is configured to be received by a foam dispenser having an air compressor located therein and configured to receive pressurized air from the air compressor through the first aperture. In addition, the refill unit may be disposed of without disposing of the air compressor.

20 Claims, 8 Drawing Sheets

(56) References Cited

U.S. PATENT DOCUMENTS

| | | | | |
|---|---|---|---|---|
| 7,543,722 | B2 | 6/2009 | Yates et al. | |
| 7,611,033 | B2 | 11/2009 | Ganzeboom | |
| 7,735,692 | B2 | 6/2010 | Nelson | |
| 7,753,087 | B2 | 7/2010 | Rhodenbaugh et al. | |
| 2005/0098580 | A1 | 5/2005 | Ciavarella | |
| 2009/0184134 | A1* | 7/2009 | Ciavarella et al. | 222/135 |
| 2009/0184136 | A1* | 7/2009 | Ciavarella | 222/190 |
| 2009/0184137 | A1 | 7/2009 | O'Brien | |
| 2009/0200337 | A1* | 8/2009 | Quinlan et al. | 222/190 |
| 2009/0200338 | A1* | 8/2009 | Quinlan et al. | 222/190 |
| 2009/0200339 | A1* | 8/2009 | Quinlan et al. | 222/190 |
| 2009/0212073 | A1 | 8/2009 | Haworth | |
| 2009/0294477 | A1* | 12/2009 | Ciavarella et al. | 222/190 |
| 2011/0079614 | A1* | 4/2011 | Ganzeboom et al. | 222/181.3 |

* cited by examiner

SPLIT BODY PUMPS FOR FOAM DISPENSERS AND REFILL UNITS

TECHNICAL FIELD

The present invention relates generally to foam pumps and more particularly to a split pump for a foam dispensing system that consists of a dispenser housing containing an air compressor portion and a refill unit for such a system. Wherein the refill unit includes a container and a liquid pump portion. The refill unit operatively engages with the dispenser housing to form a foam dispensing system.

BACKGROUND OF THE INVENTION

Liquid dispensers, such as liquid soap and sanitizer dispensers, provide a user with a predetermined amount of liquid upon the actuation of the dispenser. It is known to dispense liquids, such as soaps, sanitizers, cleansers and disinfectants from a dispenser housing that uses a removable and replaceable cartridge containing the liquid. In addition, it is sometimes desirable to dispense the liquids in the form of foam by, for example, interjecting air into the liquid creating a foamy mixture of liquid and air bubbles. It is also known to dispense liquids from a dispenser housing that uses a removable and replaceable cartridge containing liquid and a foam pump that includes a single pump that pumps air and liquid, both of which are disposed with the replaceable cartridge. Refill units that include a single pump that pumps liquid and air are more costly to manufacture than refill units containing just a liquid pump, require more plastic to make, and cost more to dispose of after the refill unit is empty.

SUMMARY

Foam dispensers, refill units for foam dispensers, and liquid pumps for use in foam dispensers are disclosed herein. In one embodiment, the foam dispenser includes a dispenser housing, an actuator connected to the dispenser housing, an air compressor portion connected to the dispenser housing and a cavity for receiving and releasably engaging with a refill unit that includes a container and a liquid pump portion. An air passage from the air compressor portion to the cavity that includes a sealing member located between the air compressor and the liquid pump portion for passing compressed air to the liquid pump portion when the refill unit is operatively engaged with the foam dispenser.

In addition, an embodiment of a refill unit for refilling a foam dispenser system is also disclosed herein. The foam dispenser has an air compressor secured thereto and the air compressor is not disposed of with the refill unit. The refill unit includes a liquid pump and a container for holding a foamable liquid that is connected to the liquid pump. The liquid pump includes a pump housing and a mixing chamber having an inlet check valve and an outlet check valve. The mixing chamber has an extended position with a first volume and a contracted position with a second volume. The pump housing includes an aperture therethrough configured to receive air from an air compressor that does not form part of the refill unit. One or more one-way sealing members are located within the pump housing between the aperture and the mixing chamber for preventing liquid from passing through the aperture in the pump housing for receiving air. A foaming element and outlet nozzle are located downstream of the mixing chamber. The refill unit is configured to be received by a foam dispenser having an air compressor located therein and configured to receive pressurized air from the air compressor through the first aperture. In addition, the refill unit may be disposed of without disposing of the air compressor.

Another embodiment of a refill unit for refilling a foam dispenser system that has an air compressor secured thereto and the air compressor is not disposed of with a refill unit includes a liquid pump and a container for holding a foamable liquid connected to the liquid pump. The liquid pump includes a pump housing that has one or more sealing members located on the outside of the pump housing. The pump housing and sealing members form at least a portion of passageway for air to travel through when the refill unit is placed in operative engagement with a foam dispenser system. The liquid pump also includes a compressible mixing chamber having an inlet check valve and an outlet check valve. The compressible chamber has an extended position with a first volume and a contracted position with a second volume. The pump housing also includes an aperture configured to receive air from an air compressor that does not form part of the refill unit. A one-way sealing member is located within the pump housing between the aperture and the mixing chamber. The liquid pump includes a foaming element and outlet nozzle located downstream of the compressible chamber. The refill unit is configured to be received by a foam dispenser having an air compressor located therein and the dispenser is configured to communicate pressurized air to the first aperture of the pump housing. In addition, the refill unit may be disposed of without disposing of the air compressor.

Another embodiment of a refill unit for refilling a foam dispenser system that contains an air compressor portion includes a liquid pump and a container for holding a foamable liquid connected to the liquid pump. In this embodiment, the liquid pump includes a pump housing and a liquid chamber having an inlet check valve and an outlet check valve. When the liquid chamber moves to a first position, foamable liquid enters the liquid chamber through the inlet check valve and when the liquid chamber moves to a second position, foamable liquid exits the liquid chamber through the outlet valve. The liquid pump also includes a mixing chamber having an inlet located proximate the outlet valve of the liquid chamber for receiving the foamable liquid. The mixing chamber includes one or more air inlets. In addition, one or more sealing members are located circumferentially about an outside of the liquid pump for engaging a surface of a dispenser system and forming an airtight passageway to the one or more air inlets. A foaming element and outlet nozzle located downstream of the mixing chamber are also included in the liquid pump. In this embodiment, when air passes through the airtight passageway it enters the mixing chamber where it mixes with the foamable liquid to form a mixture and the mixture is forced through the foaming element and out of the outlet nozzle.

BRIEF DESCRIPTION OF THE DRAWINGS

These and other features and advantages of the present invention will become better understood with regard to the following description and accompanying drawings where.

DETAILED DESCRIPTION

Figure 1:
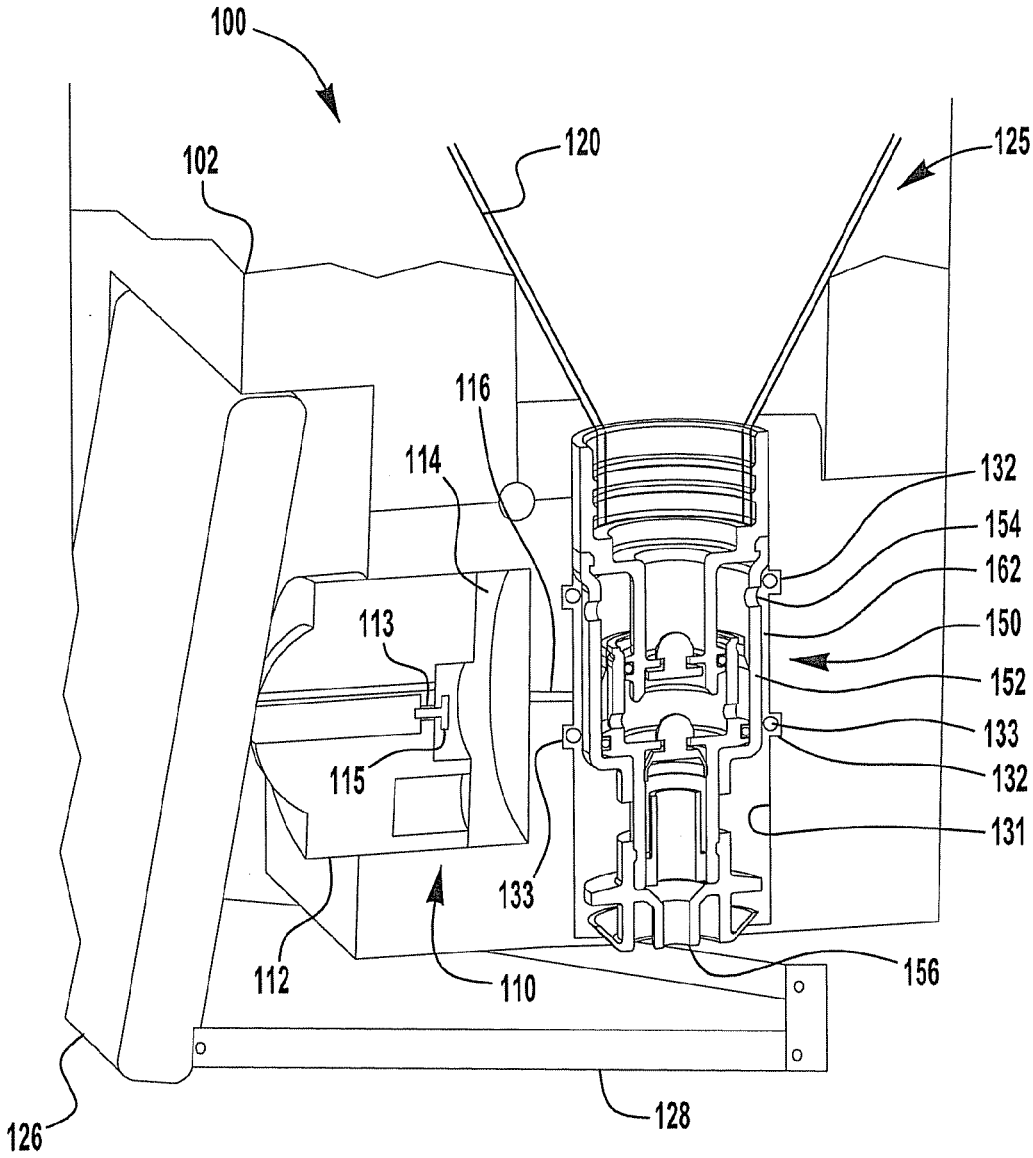
FIG. 1 illustrates an exemplary embodiment of a split pump foam dispensing system that consists of a refill including a container and a liquid pump portion and a dispenser housing containing an air compressor portion.
Figure 2:
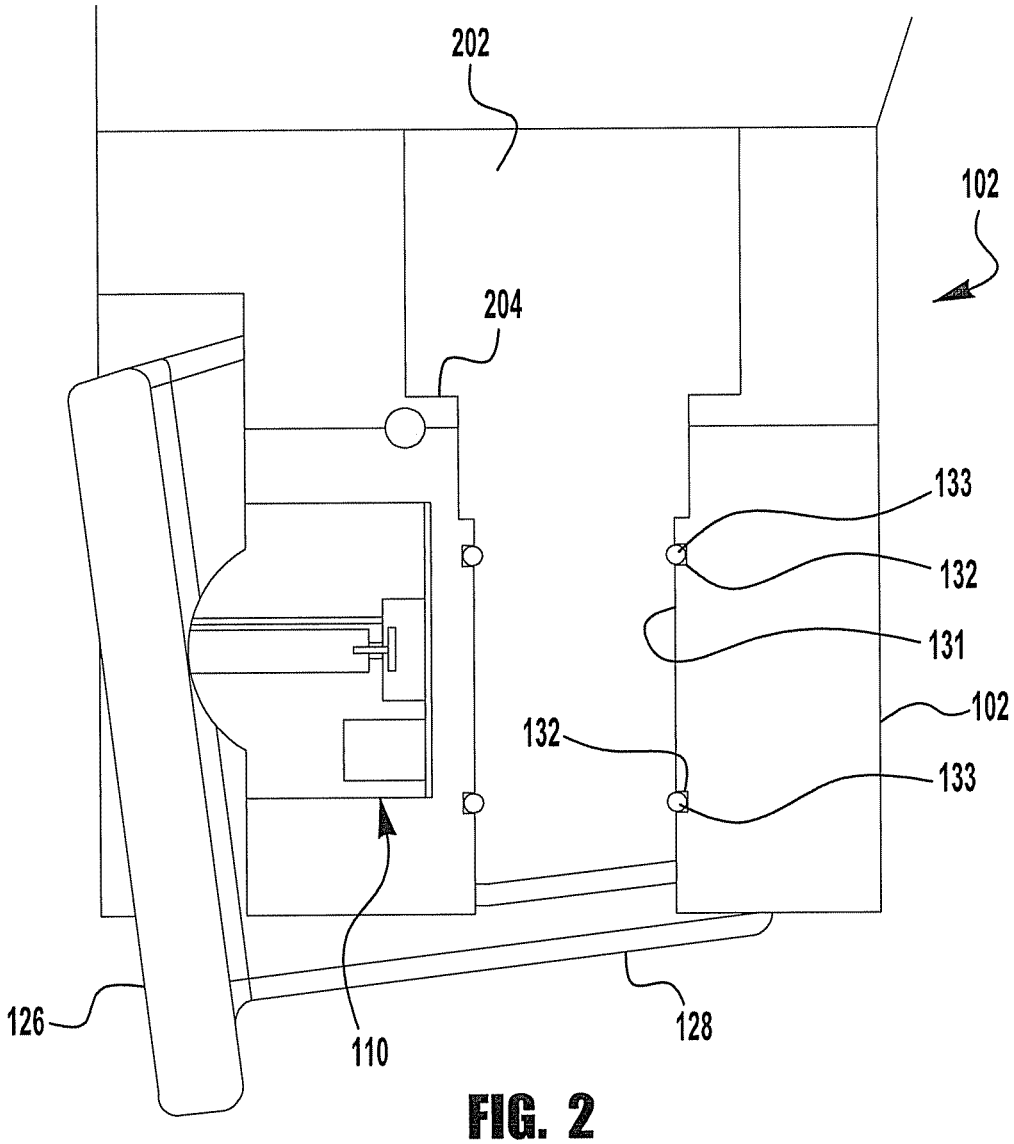
FIG. 2 illustrates an exemplary embodiment of the dispenser housing of FIG. 1 having an air compressor secured thereto and a receptacle for receiving a refill unit.
Figure 3:
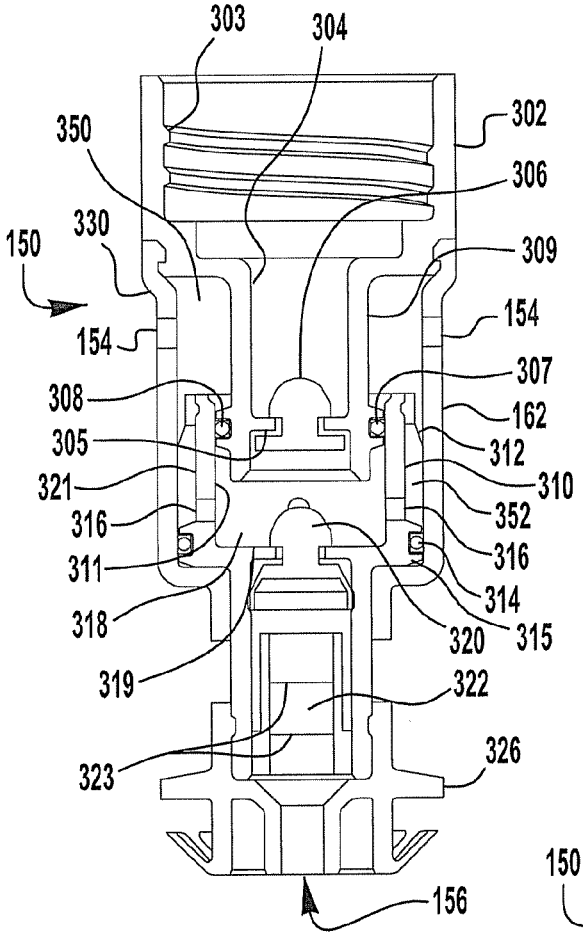
FIG. 3 illustrates the liquid pump of FIG. 1 in an expanded position.
Figure 4:
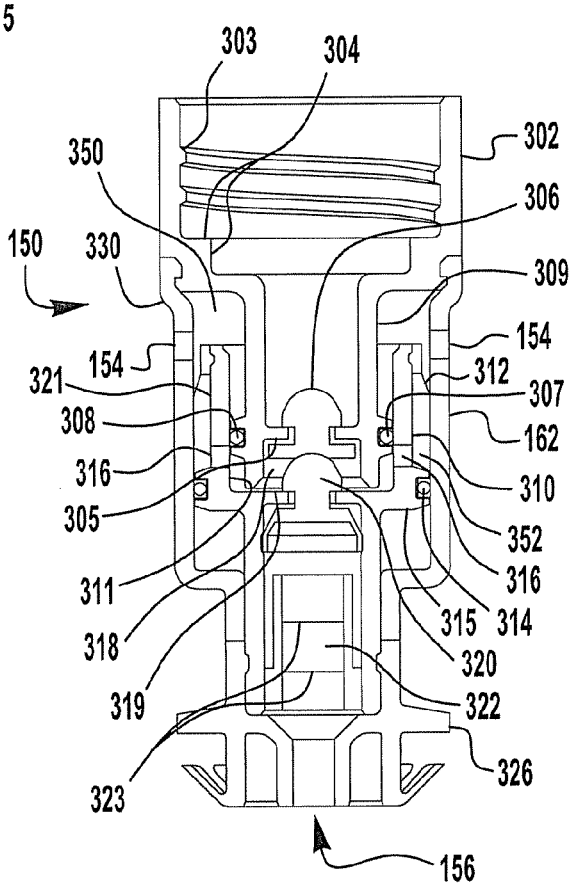
FIG. 4 illustrates the liquid pump of FIG. 3 in a compressed position.

FIG. 1 illustrates an exemplary embodiment of a split pump foam dispensing system 100 that consists of a refill unit 125 including a container 120 and a liquid pump portion 150 and a dispenser housing 102 containing an air compressor portion 110. The term "split pump" is used to describe this foam pump because the liquid pump portion is readably separable from the air compressor portion, and a foam pump is formed when the two portions are place in operative engagement with one another. The air compressor portion is secured to a dispenser housing and the liquid pump portion is secured to a container for holding a liquid. The split pump is placed in operative engagement with one another when the refill unit is placed in a foam dispenser. FIG. 2 illustrates the dispenser housing 102 and air compressor 110 of FIG. 1 and FIGS. 3 and 4 illustrate the liquid pump portion 150. Dispenser housing 102 includes an actuator 126. Actuator 126 is a manual push bar actuator; however, actuator 126 may be any type of actuator, such as, for example, an electrically activated actuator for a hands-free dispensing system, a pull bar, a lever, or other means for actuating air compressor 110. In one embodiment, actuator 126 has a liquid pump actuator 128 pivotally secured to the actuator 126 and housing 102. In one embodiment, actuation of actuator 126 also causes an upward movement of liquid pump nozzle 156. Liquid pump actuator 128 may, however, be any type of actuator, such as an electrically activated actuator for a hands-free dispensing system. Moreover, liquid pump actuator 128 may be connected to air pump actuator 126, may be actuated independently of air pump actuator 126, or may have a delayed or accelerated actuator when compared with the air compressor 110 actuator.

Air compressor 110 includes an air piston 112, and an air chamber 114 and an air outlet passage 116. In one embodiment, air compressor 110 includes an air inlet passage 113 and a check valve 115. Such an air inlet passage 113 and check valve 115 allow air to enter into air chamber 114 to recharge the air compressor. During operation, air chamber 114 remains dry or free from liquid because, as described in more detail below, liquid is prevented from traveling from the liquid pump portion 150 to the air compressor portion 110. It is desirable to prevent the air compressor 110 from being contaminated with the liquid to prevent bacteria from growing in the air chamber 114. Provided that liquid is prevented from entering into air chamber 114, air chamber 114 can have a useful lifespan that is substantially the same as foam dispenser 102.

Dispenser housing 102 also includes a cavity having a chamber wall 131. In one embodiment, chamber wall 131 includes a pair of annular channels 132. Annular channels 132 retain a sealing member 133. Sealing member 133 is preferably an elastomeric member, such as, for example, an o-ring. In such an embodiment, the outside wall of pump housing 152 may form a portion of sealing member 133 by contacting the elastomeric member 133 to form an airtight seal and create an air passageway. In one embodiment, annular channels 132 are attached to the liquid pump portion 150, such as pump housing 152. In this embodiment, the elastomeric member 133 is secured to the pump housing 152 and a wall of the dispenser 102 forms part of the sealing member by contacting the elastomeric member 133 on the pump housing 152 to form a seal.

Refill unit 125 includes container 120 and liquid pump portion 150. Liquid pump portion 150 is connected to container 120 by, for example, a threaded connection. In one embodiment, liquid pump portion 150 is cylindrical and fits within a cavity defined in part by chamber wall 131. Pump housing 152 engages sealing members 133 to form a sealed annular passageway 162 between liquid pump housing 152 and chamber wall 131. Sealing members 133 are positioned so that air inlet passage 116 through chamber wall 131 opens into annular passageway 162. Similarly, air inlet 154 through pump housing 152 opens into annular chamber 162. Liquid pump portion 150 is described in more detail with respect to FIG. 3 below.

FIG. 2 illustrates the exemplary embodiment of the foam dispenser 102 of FIG. 1 without the refill unit 125 inserted into the dispenser. Foam dispenser 102 includes a cavity 202 for receiving the refill unit. In one embodiment, cavity 202 is a cylindrical cavity and includes a ledge 204. Ledge 204 provides a support for the refill unit 125. In one embodiment, pump 150 of refill unit 125 is also cylindrical and has a lip 330 (FIG. 3) which rests on ledge 204. A mechanical locking mechanism (not shown) may be provided to lock or hold refill unit 125 in place after it is placed in foam dispenser 102. As described with respect to FIG. 1, foam dispenser 102 contains an air compressor 110 and sealing members 133. Air compressor 110 is illustrated as a piston pump; however, air compressor 110 may be any type of air compressor, such as, for example, a bellows pump, a dome pump or a cylindrical piston pump having an open center wherein the air pump at least partially surrounds the liquid pump portion 150 when the liquid pump portion 150 is correctly positioned in the foam dispenser 102.

FIG. 3 illustrates an exemplary embodiment of a liquid pump portion 150. Liquid pump portion 150 includes a cap section 302. Cap section 302 has a threaded region 303 for connecting to a container (not shown) for holding a foamable liquid. In one embodiment, threaded region 303 is replaced with a different engagement region for engaging with the container, the different engagement region may be, for example, a region for receiving an adhesive for binding with the container or a welding region for welding the pump portion 150 to the container. Cap section 302 includes a cylindrical recess 304 that has a base 305. Base 305 has an aperture therethrough in which one-way check valve 306 is positioned. One-way check valves described and used in embodiments herein may flapper valves, conical valves, plug valves, umbrella valves, duck-bill valves, ball valves, slit valves, etc. On the exterior sidewall 309 of cylindrical recess 304 is an annular recess 307. Annular recess 307 contains a sealing member, such as for example an o-ring 308. Cylindrical recess 304 and pump housing 162 are stationary. Piston 310 has a cylindrical shape and is sized to fit over the outside wall 309 of cylindrical recess 304. Sidewall 311 of piston 310 makes a sealing engagement with o-ring 308. Piston 310 includes a bottom wall 319 with an aperture therethrough. Within the aperture is a one-way outlet valve 320. One-way outlet valve 320 may be any one-way valve, such as, for example, a mushroom valve. A mixing chamber 318 is formed by piston 310 and cylindrical recess 304. Inlet valve 306 permits fluid to enter the mixing chamber from a liquid container (not shown). Piston 310 includes one or more air inlet apertures 316 through wall 311. In addition, piston 310 has an outside wall 321. Piston outside wall 321 includes a channel 315 with a sealing member 314, such as, for example, an o-ring located therein. Sealing member 314 provides a seal between piston 310 and pump housing 162. In addition, secured to piston 310 is a one-way sealing valve 312. One-way sealing valve 312 may be any type of one-way valve, such as for example, a wiper seal. Sealing valve 312 is a sanitary seal in that it prevents liquid from escaping out through the air inlet and contaminating the air compressor or coming into contact with elements of the foam dispenser that are not disposed of when disposing of the refill unit. Other sanitary seals may be used, such as, for example, a shuttle valve. In one embodiment, liquid pump portion 150 includes a foam generator 322. Foam generator 322 may include one or more screens 323. Liquid pump portion 150 contains a dispensing nozzle 156 that may include an engagement mechanism, such as protrusion 326, for engagement with a foam soap dispenser.

FIG. 3 illustrates pump portion 150 in its expanded position. Pump portion 150 may be biased to its expanded position by, for example, a spring (not shown). In its expanded position, mixing chamber 318 has a first volume. Optionally, pump portion 150 may be returned to its expanded position by the actuator of the foam soap dispenser. FIG. 4 illustrates pump portion 150 in its contracted position. In this position, mixing chamber 318 has a second volume that is less than the first volume. In addition, one-way sealing valve 312 remains below, or downstream of, air inlet(s) 154 to prevent passage of liquid, air or a mixture thereof, from escaping through inlet 154. When liquid pump portion 150 moves from its contracted position to its expanded position, one-way valve 320 closes and a vacuum is created that draws liquid from cylindrical cavity 304 past one-way valve 306 to fill mixing chamber 318.

During operation, movement of actuator 126 causes compressed air from air compressor 110 to flow through air outlet passage 116 into annular chamber 162 and through air inlet 154 into first chamber 350. Air flows through first chamber 350 past one-way sealing valve 312 into second chamber 352 and through air inlet aperture 316 into mixing chamber 318 and mixes with the liquid to form a mixture. Mixing chamber 318 of liquid pump portion 150 is also compressed by actuating mechanism 128. Actuating mechanism 128 may be configured to compress mixing chamber 318 simultaneously with compression of air chamber 114, or more preferably, actuating mechanism 128 delays compression of mixing chamber 318 until a substantial quantity of air has passed through mixing chamber 318. The mixture is forced past one-way valve 320 and through foam generator 322 and out of nozzle 156. Liquid and/or the liquid air mixture is prevented from exiting mixing chamber 318 through apertures 316 by the pressure of the incoming compressed air. In addition, sealing member 312 prevents any liquid or liquid air mixture that does escape mixing chamber 318 through aperture 316 from passing out of the liquid pump portion 150. Accordingly, liquid cannot contaminate air compressor 110 which remains with foam dispensing unit 102 when the refill unit 125 is changed out or replaced.

Figure 5:
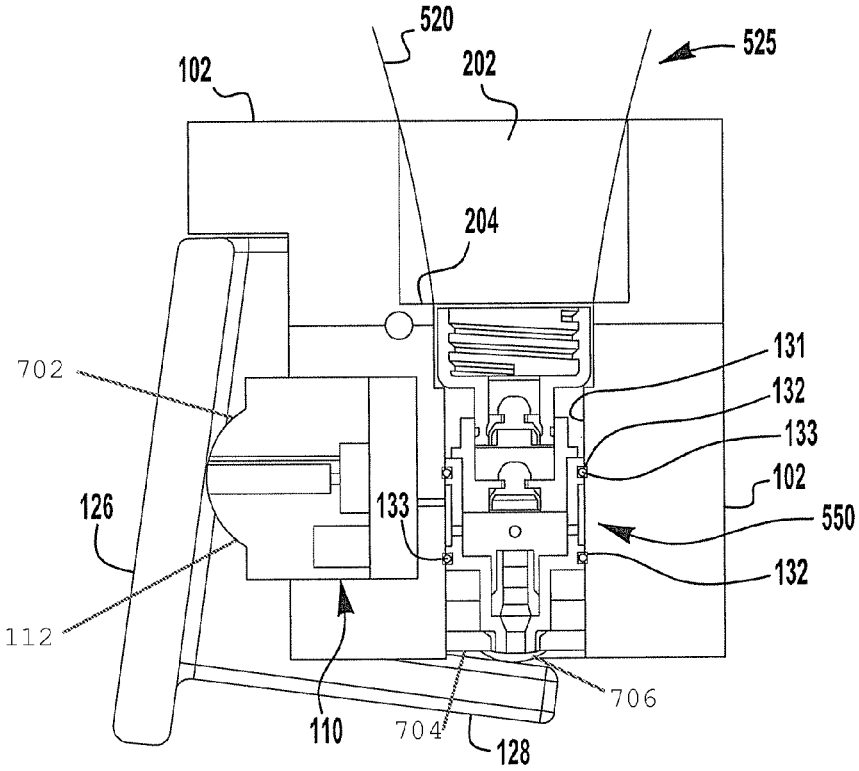
FIG. 5 illustrates another exemplary embodiment of a split pump foam dispensing system that consists of a refill including a container and a liquid pump portion and a dispenser housing containing an air compressor portion.

FIG. 5 illustrates substantially the same foam dispenser 102 having air compressor 110 as shown in FIG. 1. One difference is the sealing members 634 are located on pump housing 630 rather than on foam dispenser 102. Piston 112 of air compressor 110 includes a rounded top portion 602. Rounded top portion 602 provides a contact point for actuator 126. As actuator 126 pivots, it contacts and rolls over rounded top portion 602 to push air piston 112 inward. A connecting member (not shown) may be connected between actuator 126 and air piston 112 to pull air piston 112 outward to expand air chamber 114. Preferably, such a connecting member is loosely linked so that it is the rounded top portion 602, not the connecting member, to which force is applied by actuator 126 to compress air chamber 114. Optionally, a spring (not shown) or other biasing member may be used to return air chamber 114 to an expanded state. In addition, dispenser 102 may include a bracket 604 connected to liquid pump actuator member 128. Bracket 604 includes an aperture (not shown) that fits over nozzle 646 a connecting member 606 may be connected to both nozzle 646 and to bracket 604 so that the bracket applies upward force to pump portion 550 to compress the liquid chamber 628 and upon release of actuator 126, liquid chamber 628 is returned to its expanded position by the same force that moves actuator 126 back to its original position. Connecting member 606 may connect to nozzle 646 by a friction fit, snap fit, or other releasable type connection that will allow for easy removal of liquid pump portion 550. Foam dispenser 102 as shown is in its extended, or charged position. Air chamber 114 is expanded and full of air.

In addition, refill unit 525 is also illustrated in FIG. 5. Refill unit 525 includes liquid pump portion 550 connected to container 520 and operatively engages with air compressor 110. Refill unit 525 may be readily inserted into dispenser by, for example, dropping it in place. Similarly, refill unit 525 may be readily removed from dispenser 102 by lifting upward.

Figure 6:
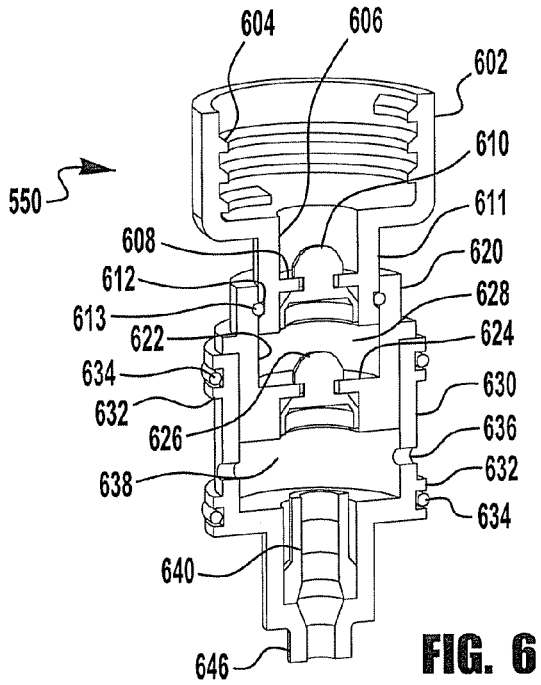
FIG. 6 illustrates the liquid pump of FIG. 5 in an expanded position.

Liquid pump portion 550 is in its expanded position and is more fully described with respect to FIG. 6. Liquid pump portion 550 is an exemplary embodiment of a liquid pump portion suitable for use in the present invention. Liquid pump portion 550 includes a cap section 602. Cap section 602 has a threaded region 604 for connecting to a container (not shown) for holding a foamable liquid. In one embodiment, threaded region 604 is replaced with a different engagement region for engaging with the container. The different engagement region may be, for example, a region for receiving an adhesive for binding with the container or a welding region for welding the pump portion 550 to the container. Cap section 602 includes a cylindrical recess 606 that has a base 608. Base 608 has an aperture therethrough in which one-way check valve 610 is positioned. One-way check valve 610 may be any type of check valve, such as, for example, an umbrella valve. On the exterior sidewall 611 of cylindrical recess 606 is an annular recess 612. Annular recess 612 contains a sealing member, such as for example an o-ring 613. Liquid pump portion 550 includes a liquid chamber body 620. Inside wall 622 of liquid chamber body 620 is slidably engaged with exterior sidewall 611 of cylindrical recess 606. Liquid chamber body 620 includes a base 624 that has aperture therethrough. One-way valve 626, such as, for example, an umbrella valve, is located in the aperture. Liquid chamber body 620 and cylindrical chamber 606 form a liquid chamber 628. Liquid chamber 628 is illustrated in its expanded position. Liquid chamber body 620 is a piston that slides up cylindrical chamber 606 to reduce the volume of liquid chamber 628.

Liquid pump portion 550 also includes a mixing chamber 638. Liquid enters mixing chamber 638 by flowing past outlet valve 626. Mixing chamber 638 is partially formed by pump housing 630, which includes one or more apertures 636. Pump housing 630 also includes a pair of annular channels 632 that holds sealing members 634, such as, for example, an o-ring. The sealing members 634 seal against dispenser 102 and form an air passageway from air compressor 110 to air inlet 636. In addition, pump housing 630 includes a foam generator 640 and an outlet nozzle 646. In one embodiment, sealing members 634 are located in the dispenser (as illustrated in FIG. 2) and a seal is formed against a surface of the pump housing.

Figure 7:
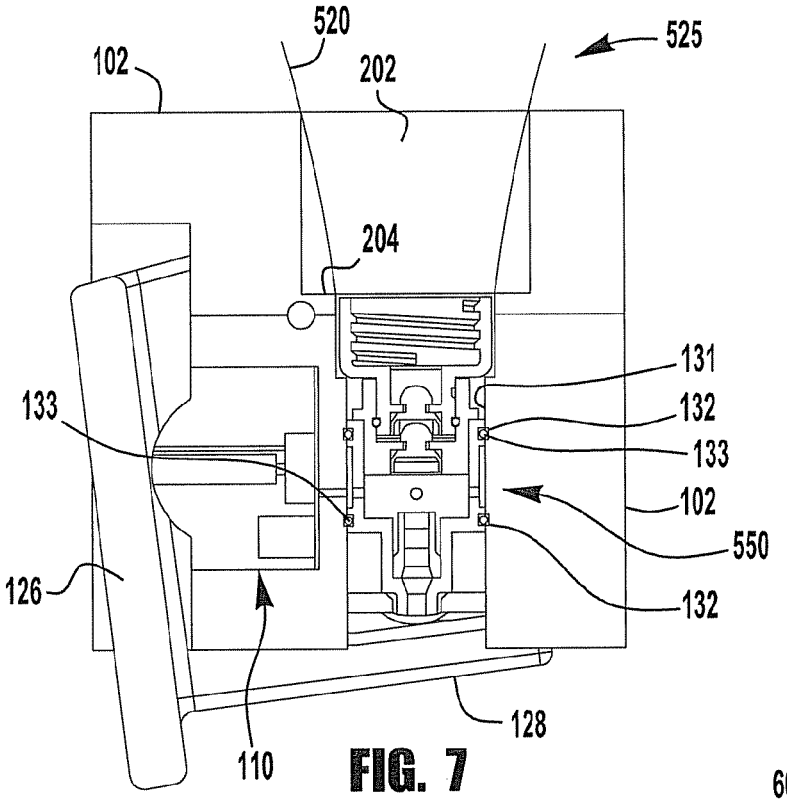
FIG. 7 illustrates the exemplary embodiment of FIG. 5 in a compressed position.

FIG. 7 illustrates the foam dispensing system of FIG. 6 with the actuator 126 actuated. Air chamber 114 is compressed and liquid chamber 628 is also compressed.

Figure 8:
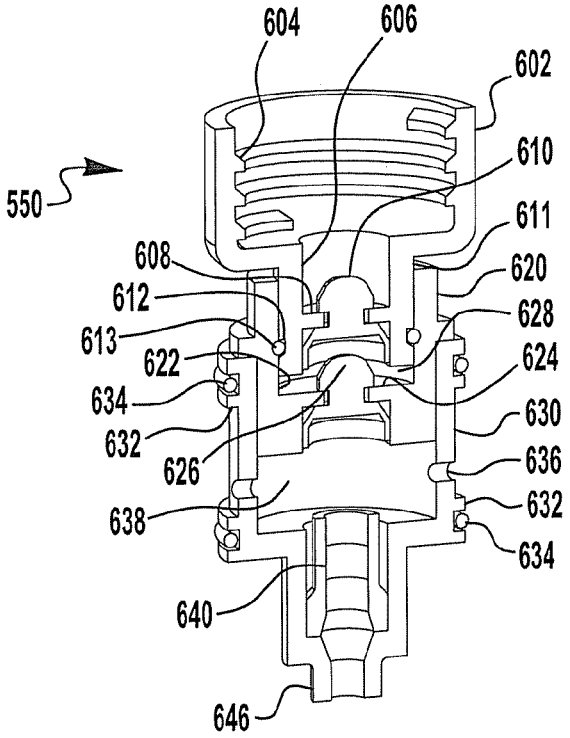
FIG. 8 illustrates the liquid pump of FIG. 7 in a compressed position.

FIG. 8 illustrates the liquid pump portion 550 of FIG. 6 in its compressed position. Liquid chamber is 628 is returned to its expanded position by the actuator mechanism 126, which may include a spring to bias the actuator 126 in a first position. In one embodiment, liquid pump portion 550 includes a mechanism, such as a spring (not shown), to return liquid chamber 628 to its expanded position.

Figure 9:
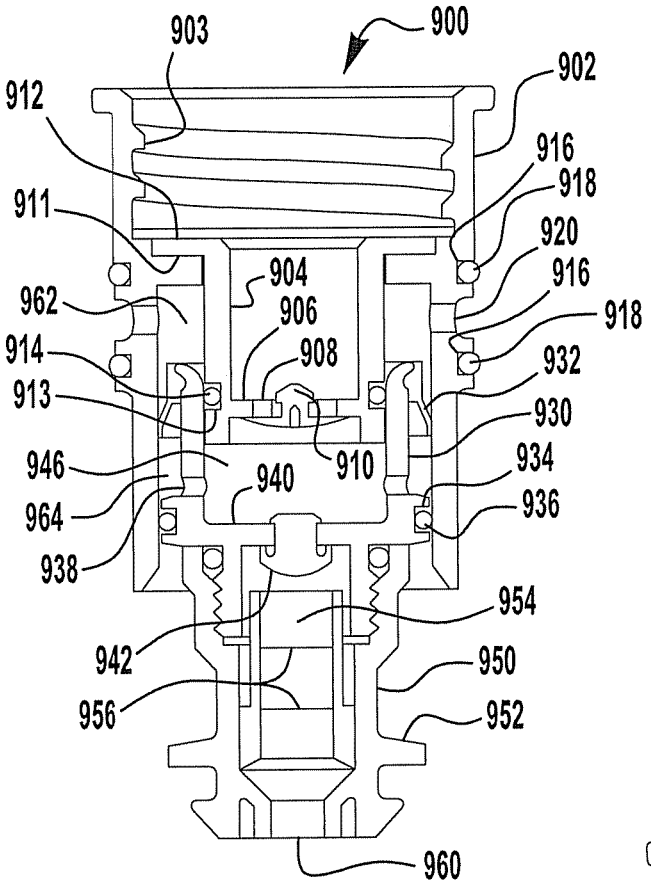
FIG. 9 illustrates another exemplary embodiment of a liquid pump portion in an expanded position.

FIG. 9 illustrates another exemplary embodiment of a liquid pump portion 900 for use with a dispenser having an air compressor secured thereto. Liquid pump portion 900 includes a housing 902 having a threaded portion 903 for connecting to a liquid container (not shown). Housing 902 includes a pair of annular recesses 916 for retaining a sealing member 918, such as, for example, an o-ring. Sealing members 918 are on opposite sides of air inlet opening 920. When liquid pump portion 900 is releasably secured to a foam dispenser, sealing members 918 form a portion of an air passageway from an air compressor located in the foam dispenser to the interior of the liquid pump. Housing 902 includes a ledge 911 with an opening therethrough. A cylindrical liquid inlet housing 904 having a flange 912 is inserted into the opening in housing 902. Flange 912 rests on ledge 911. Optionally, a sealing member, such as, for example, a gasket or grease may be used between flange 912 and ledge 911 to ensure a liquid-tight seal. Cylindrical liquid inlet housing 904 includes a base 906 having one or more apertures 908 therethrough and a one-way check valve 910 secured thereto. One-way check valve 910 allows liquid into mixing chamber 946 but prevents air or liquid from passing back through the apertures and back into a liquid container (not shown). One-way check valve 910 is shown as an umbrella check valve, but may be any type of one-way check valve, and in one embodiment is a slit valve. Cylindrical liquid inlet housing 904 also includes an annular recess 913 having a sealing member 914, such as, for example an o-ring. Sealing member 914 provides a seal between cylindrical liquid inlet housing 904 and liquid chamber housing 930. Liquid chamber housing 930 moves up and down with respect to cylindrical liquid inlet housing 904. Liquid chamber housing 930 has a sealing member 932 secured thereto. Sealing member 932, may be for example, a wiper seal. Sealing member 932 may be referred to as a sanitary seal because it prevents liquid from traveling out of the liquid pump portion 900 and into the air compressor. Liquid chamber housing 930 also includes an annular recess 934 having a sealing member 936, such as, for example, an o-ring. In addition, an air inlet aperture 938 is located in a wall of liquid chamber housing 930. Liquid chamber housing 930 includes a base 940 having an aperture therethrough with a one-way outlet check valve 942 located therein.

Secured to liquid chamber housing 930 by, for example a threaded fitting, is nozzle 950. Nozzle 950 includes a foaming chamber 954 that has a one or more foaming elements 956 located therein, such as for example, a foaming cartridge, screens, mesh or a sponge. Nozzle 950 includes an actuating engagement member 952 for engaging with an actuator of a foam dispenser (not shown).

Figure 10:
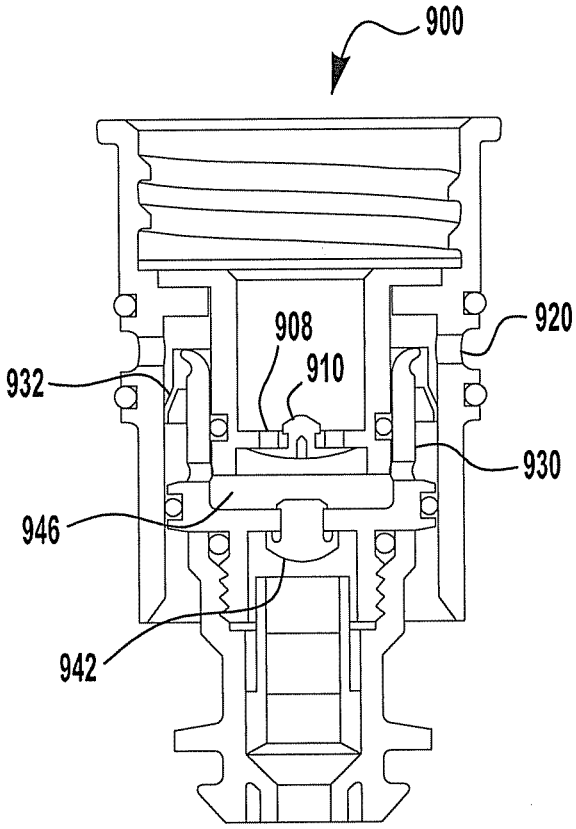
FIG. 10 illustrates another exemplary embodiment of a liquid pump portion in a compressed position.

During operation, liquid pump portion 900 including a liquid container are releasably connected to a foam dispensing unit similar to the foam dispensing unit of FIG. 5, except the foam dispensing unit has a different actuator that engages with actuator engagement member 952 to compress liquid pump portion 900. An air passageway is formed at least partially between housing 902 and one or more surfaces of the dispenser unit by means of sealing members 918. Upon actuation of the foam dispenser, compressed air travels through the air passageway and through aperture 920 into a first air chamber. The compressed air travels past sealing member 932 into a second air chamber 964 and through aperture 938 into mixing chamber 946 where it mixes with a liquid to form a mixture. The mixture is forced out of mixing chamber 946 by the compressed air and because mixing chamber 946 is collapsible and during the compression stroke, the volume of mixing chamber 946 is reduced (FIG. 10). Sealing member 932, or sanitary seal, prevents liquid from escaping housing 902. When the actuator (not shown) moves back to its original position, pump portion 900 returns to the position shown in FIG. 9. This may be accomplished by the actuator or by a biasing means on the pump, such as, for example, a spring. A vacuum is drawn in mixing chamber 946 causing outlet check valve 942 to seal shut and liquid to be drawn into mixing chamber 946 past inlet check valve 910. In addition, the air compressor is recharged with air and the system is primed and ready to dispense again.

Figure 11:
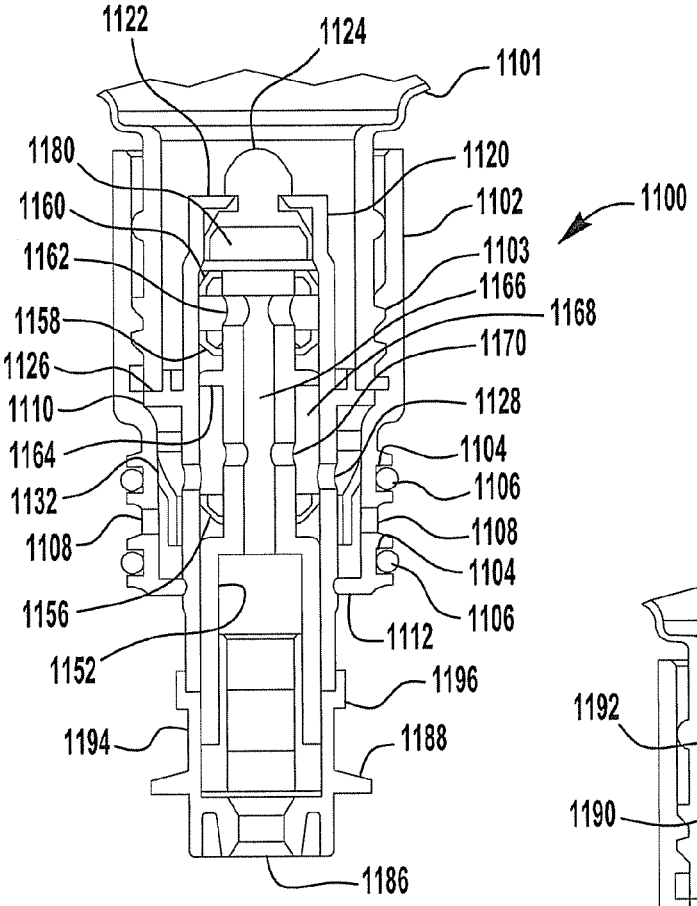
FIG. 11 illustrates another exemplary embodiment of a liquid pump portion in an expanded position.
Figure 12:
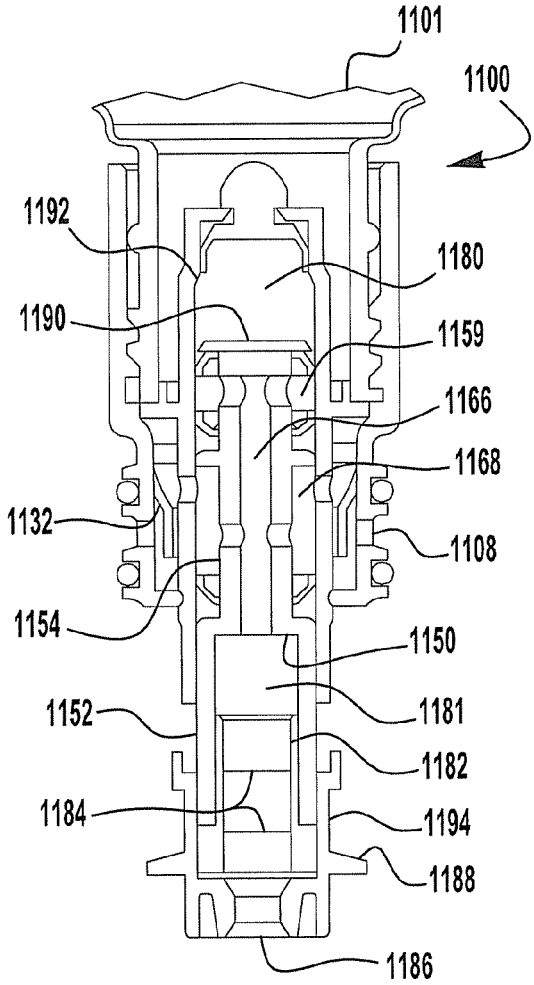
FIG. 12 illustrates another exemplary embodiment of a liquid pump portion in a compressed position.

FIGS. 11 and 12 illustrate an additional exemplary embodiment of a pump portion 1100 for use with a foam dispenser having an air compressor portion secured thereto, such as for example, the foam dispenser of FIG. 5. Liquid pump portion 1100 is secured to a liquid container 1101. Liquid pump portion 1100 includes a housing 1102. Housing 1102 is cylindrical and includes threads 1103 for securing housing 1102 to container 1101. As discussed above, many different means for connecting the container 1101 to liquid pump portion 1100 are contemplated herein. Housing 1102 has one or more annular channels 1104 for holding sealing members 1106. Sealing members 1106 are preferably elastomeric, and in one embodiment are o-rings. Sealing members 1106 contact a portion of a foam dispenser (not shown) and partially define an air passageway from an air compressor (not shown) in the foam dispenser. In addition, housing 1102 includes one or more air inlet apertures 1108. In one embodiment, housing 1102 also includes ledge 1110 and a bottom surface 1112 that has an opening therein. Ledge 1110 may simply be a transition area from a first diameter to a second smaller diameter of cylindrical housing 1102. Ledge 1110 provides a support for piston body 1120, and the opening in the bottom surface 1112 allows piston body 1120 to pass through. Piston body 1120 includes an annular projection 1126. Annular projection 1126 rests on ledge 1110 and provides a surface that mates up with container 1101 to form a liquid tight seal with container 1101. Optionally, a gasket (not shown) or a type of sealant may be used in combination with annular projection 1126 to form a seal between liquid pump portion 1100 and container 1101. When connected to the container 1101, ledge 1110, bottom surface 1112 and container 1101 secure piston body 1120 in a stationary position with respect to housing 1102.

Piston body 1120 includes air inlet opening 1170 and one-way sealing member 1132, which may be, for example, a wiper seal. One-way sealing member 1132 may also be called a sanitary seal because it prevents liquid from passing by and exiting pump housing 1102 through air inlet aperture 1108 or the opening in bottom surface 1112. Preventing liquid from exiting housing 1102 through air inlet aperture 1108 is one of the features that allows the air compressor portion to be secured to the pump housing and not disposed of with the refill unit that consists of a container and the liquid pump portion. Piston body 1120 has a wall 1122 with an aperture therethrough, that retains liquid inlet valve 1124. Inlet valve 1124 may be any type of one-way valve, such as for example, an umbrella valve. In one embodiment inlet valve 1124 is a slit valve.

Piston 1150 fits within piston body 1120. Piston body 1120 is hollow and has a first cylindrical portion 1152 that fits within piston body 1120. Piston body 1120 has a second cylindrical portion 1154. Second cylindrical portion 1154 has a first sealing member 1156, such as for example, a wiper valve. First sealing member 1156 rides along the inside wall of piston body 1130 and prevents air and liquid from passing between first cylindrical portion 1152 and piston body 1130 and out of the end of pump portion 1100. Second cylindrical portion 1154 includes a stabilizing member 1164 that contacts the interior wall of piston body 1130 and helps to maintain alignment of piston 1150. In addition, second cylindrical portion 1154 includes a second sealing member 1158 and third sealing member 1160. Third sealing member 1160 is a one-way sealing member, such as a wiper valve, which allows liquid to pass from liquid chamber 1180 into passage 1159, but prevents liquid from flowing back up into liquid chamber 1180 once it has passed third sealing member 1160. First and second sealing members 1156 and 1158 are also one-way sealing members; however, optionally, one or both of sealing members 1156 and 1158 are sealing members that block the passage of liquid or air in either direction. Second cylindrical portion 1154, second sealing member 1158 and third sealing members 1160 form a liquid passage 1159. One or more apertures 1162 in second cylindrical portion 1154, between second sealing member 1158 and third sealing member 1160, allow passage of liquid into mixing chamber 1166.

The upper portion of piston body 1130 tapers inward at 1192. Piston 1150 has a head 1190. Liquid chamber 1180 is formed between piston body 1120, inlet valve 1124 and piston 1150. During shipping of a refill unit, head 1190 contacts piston body 1130 at 1192 and seals liquid chamber 1180, forming a shipping seal. This shipping seal prevents liquid from escaping out of the refill unit during shipping and does not require the removal of the seal prior to operation.

Nozzle 1194 connects to piston 1150, by for example, an adhesive, a slip fit connection, a threaded connection or any other means suitable for connecting nozzle 1194 to piston 1150. Prior to connecting nozzle 1194 to piston 1150, a foaming cartridge 1182 is inserted into outlet chamber 1181. Foaming cartridge 1182 may include one or more screens 1184. Nozzle 1194 includes an outlet 1186 and a actuator engaging member 1188. Actuator engaging member 1188 engages with an actuator (not shown) to operate liquid pump portion 1100.

FIG. 11 illustrates the liquid pump portion 1100 in a compressed position, and FIG. 12 illustrates liquid pump portion 1100 in an expanded position. During operation, liquid pump portion 1100 is moved from its compressed position to its expanded position, which creates a vacuum in liquid chamber 1180 and causes liquid to flow into liquid chamber 1180 from container 1101. As liquid pump portion 1100 moves back to its compressed position, the liquid in liquid chamber 1180 flows past one-way sealing member 1160 and through liquid inlet aperture 1162 into mixing chamber 1166. Simultaneously, compressed air, from an air compressor secured to a foam dispensing unit (not shown), passes through a passageway defined at least in part by housing 1102 and sealing member(s) 1106 through one or more air inlet aperture 1108 in housing 1102, past sealing member 1132, through one or more apertures 1128 in piston body 1130 into passage 1168 and through one or more apertures 1170 in piston 1150 and into mixing chamber 1166. Once in mixing chamber 1166, the air and liquid mix together in a swirling motion to form a mixture that is expelled into outlet chamber 1181, through foaming cartridge 1182 and dispensed as a foam through outlet 1186.

Figure 13:
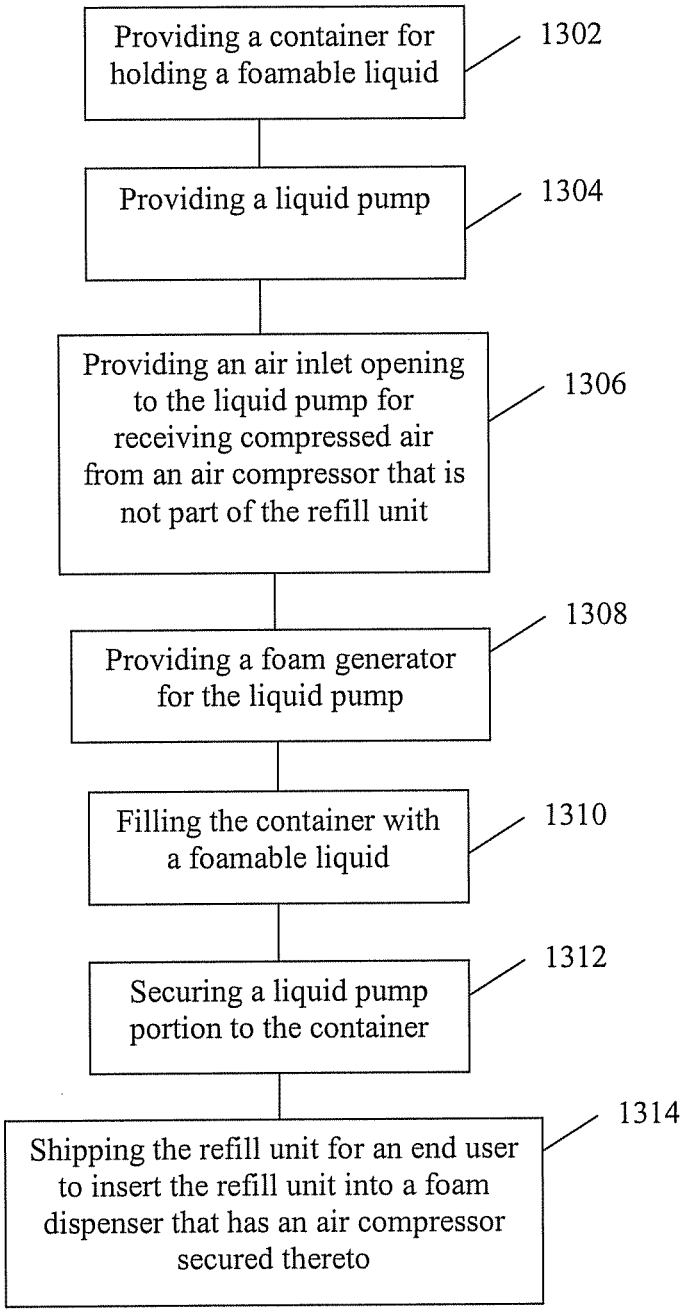
FIG. 13 illustrates an exemplary embodiment of a method for providing a refill unit for a split pump foam dispensing system.

FIG. 13 illustrates an exemplary method of producing a refill unit for a foam dispenser wherein the foam dispenser has an air compressor attached thereto that is not replaced when the refill unit is replaced. Although the exemplary method is presented in a specific order, no particular order is required to perform these steps, and various combinations or groupings of different steps may be used in accordance with the present invention. The exemplary method begins by providing a container for holding a foamable liquid at block 1302 and a liquid pump portion is provided at block 1304. An air inlet opening in the liquid pump portion for receiving compressed air from an air compressor that is not part of the refill unit is provided at block 1306. At block 1308, a foam generator is provided for the liquid pump portion. The liquid container is filled at block 1310 and the liquid pump is secured to the liquid container at block 1312. The refill unit is shipped to an end user to insert the refill unit into a foam dispenser that has an air compressor secured thereto at block 1314.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. For example, the liquid pump portion may include a different mechanism for pumping the liquid, such as a bellows pump, a dome pump or a piston pump. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A refill unit for refilling a foam dispenser system that has an air compressor secured thereto and the air compressor is not disposed of with the refill unit, the refill unit comprising:

a liquid pump; and a container for holding a foamable liquid connected to the liquid pump;

the liquid pump including:

a pump housing;

a mixing chamber having an inlet check valve and an outlet check valve;

the mixing chamber having an extended position with a first volume and a contracted position with a second volume;

wherein movement of the mixing chamber from the contracted position to the extended position causes foamable liquid to enter the mixing chamber and movement from the extended position to the contracted position causes foamable liquid to flow out of the mixing chamber;

an air inlet aperture through the pump housing configured to receive air from an air compressor that does not form part of the refill unit;

an air passageway from the air inlet aperture to the mixing chamber;

a sanitary seal located within the air passageway and outside of the mixing chamber for preventing liquid from passing through the air aperture in the pump housing;

a foaming element located downstream of the mixing chamber; and an outlet nozzle;

wherein the refill unit is configured to be received by a foam dispenser having an air compressor located therein and being configured to communicate pressurized air to the first aperture, and wherein the refill unit may be disposed of without disposing of the air compressor.

2. The refill unit of claim 1 further comprising a sealing member on the exterior of the pump housing for creating a passageway between the pump housing and the foam dispenser when the refill unit is installed in the foam dispenser.

3. The refill unit of claim 1 further comprising an air inlet aperture located in the mixing chamber.

4. The refill unit of claim 1 wherein the one or more one-way sealing valves comprise an annular flapper valve.

5. The refill unit of claim 1 wherein one or more of the check valves is an umbrella valve.

6. The refill unit of claim 1 further comprising a second sealing member located between the mixing chamber and the pump housing.

7. A refill unit for refilling a foam dispenser system that has an air compressor secured thereto and the air compressor is not disposed of with a refill unit comprising:

a liquid pump; and a container for holding a foamable liquid connected to the liquid pump;

the liquid pump including:

a pump housing;

the pump housing having one or more sealing members located on the outside of the pump housing, the pump housing and sealing members forming at least a portion of the passageway for air to travel through when the refill unit is placed in operative engagement with a foam dispenser system;

a compressible mixing chamber having an inlet check valve and an outlet check valve;

the compressible chamber having an extended position with a first volume and a contracted position with a second volume;

wherein movement from the contracted position to the extended position draws liquid into the mixing chamber, and movement from the extended position to the contracted position causes liquid to flow out of the mixing chamber;

an aperture through the pump housing configured to receive air from an air compressor that does not form part of the refill unit;

a one-way sealing valve located within the pump housing between the aperture and the mixing chamber;

a foaming element located downstream of the compressible chamber; and an outlet nozzle;

wherein the refill unit is configured to be received by a foam dispenser having an air compressor located therein and being configured to communicate pressurized air to the first aperture, and wherein the refill unit may be disposed of without disposing of the air compressor.

8. The refill unit of claim 7 wherein the one or more sealing members located outside of the pump housing comprises one or more o-rings.

9. The refill unit of claim 7 wherein the one-way sealing valve located within the pump housing between the aperture and the mixing chamber comprises an annular wiper valve.

10. The refill unit of claim 7 wherein the one or more apertures in the pump housing are located upstream of the one-way sealing valve located within the pump housing.

11. A refill unit for refilling a foam dispenser system that contains an air compressor portion comprising:

a liquid pump;

a container for holding a foamable liquid connected to the liquid pump;

the liquid pump including:

a pump housing;

a liquid chamber having an inlet check valve and an outlet check valve;

the liquid chamber is formed by a first housing member, wherein the inlet check valve is secured to the first housing member; and a second housing member, wherein the outlet check valve is secured to the second housing member;

an annular seal surrounding one of the first housing member or the second housing member;

wherein when the liquid chamber moves to a first position the inlet and outlet valves move to a first distance from one another and foamable liquid enters the liquid chamber through the inlet check valve, and wherein when the liquid chamber moves to a second position the inlet and outlet valves move to a second distance from one another and foamable liquid exits the liquid chamber through the outlet valve;

a mixing chamber having an inlet located proximate the outlet valve of the liquid chamber for receiving the foamable liquid;

the mixing chamber having a one or more air inlets;

one or more sealing members located on the outside of the liquid pump for engaging a surface of a dispenser system and forming an airtight passageway to the one or more air inlets;

a foaming element located downstream of the mixing chamber; and an outlet nozzle;

wherein when air passes through the airtight passageway, it enters the mixing chamber where it mixes with the foamable liquid to form a mixture and the mixture is forced through the foaming element and out of the outlet nozzle.

12. The refill unit of claim 11 wherein the sealing member is a surface on the pump housing that contacts an elastomeric element on the dispenser to form an air passageway between the dispenser and the air inlet.

13. The refill unit of claim 11 wherein the sealing member is an elastomeric element on the surface of the pump housing that contacts a surface on the dispenser to form an air passageway between the dispenser and the air inlet.

14. A foam dispenser comprising:

a dispenser housing;

an actuator connected to the dispenser housing;

an air compressor portion connected to the dispenser housing;

the actuator having a first member that is movable to reduce and expand the volume of the air compressor portion and a second member that is movable to move the outlet nozzle of a refill unit upward to compress a mixing chamber in the refill unit when a refill unit is in the dispenser and the dispenser is operated, wherein compression of the mixing chamber causes liquid to flow out of the mixing chamber;

a cavity for receiving and releasably engaging with a refill unit that includes a container and a liquid pump portion;

an air passage from the air compressor portion to the cavity;

a sealing member for providing an air passageway between the air compressor and the liquid pump portion for passing compressed air to the liquid pump portion when the refill unit is operatively engaged with the foam dispenser.

15. The foam dispenser of claim 14 wherein sealing member is an elastomeric member secured to the dispenser.

16. The foam dispenser of claim 14 wherein the sealing member is a surface configured to operatively engage with an elastomeric member secured to the refill unit.

17. The foam dispenser of claim 14 wherein the actuator is a manual actuator.

18. The foam dispenser of claim 14 wherein at least a portion of the cavity is cylindrical.

19. The foam dispenser of claim 14 further comprising a refill unit.

20. The foam dispenser of claim 19 wherein the refill unit comprises a liquid pump portion and wherein the liquid pump portion comprises a mixing chamber having an air inlet opening therein.

* * * * *